United States Patent [19]

Byrd

[11] Patent Number: 4,902,196

[45] Date of Patent: Feb. 20, 1990

[54] GAS-MOVING DEVICE

[75] Inventor: Geoffrey C. M. Byrd, Warrington, England

[73] Assignee: Imperial Chemical Industries PLC, London, England

[21] Appl. No.: 284,808

[22] Filed: Dec. 14, 1988

Related U.S. Application Data

[63] Continuation of Ser. No. 47,521, May 4, 1987, abandoned, which is a continuation of Ser. No. 775,362, Sep. 12, 1985, abandoned.

[30] Foreign Application Priority Data

Sep. 12, 1984 [GB] United Kingdom ..... 8423045

[51] Int. Cl.[4] ..... F04D 29/26

[52] U.S. Cl. ..... 415/90; 415/141; 416/240

[58] Field of Search ..... 415/90, 141; 416/223 R, 416/4, 240, 241 A; 15/159 A

[56] References Cited

U.S. PATENT DOCUMENTS

| | | | |
|---|---|---|---|
| 86,320 | 1/1869 | Reichenbach et al. | 415/141 |
| 1,908,230 | 5/1933 | Fawkes | 415/90 X |
| 2,245,632 | 6/1941 | Winkler | 415/90 X |
| 2,998,099 | 8/1961 | Hollingsworth | 415/90 X |
| 3,353,200 | 11/1967 | Charvat | 15/159 A X |
| 3,538,657 | 11/1970 | Macrow | 415/141 X |
| 3,969,090 | 7/1976 | Sasena et al. | 15/159 A X |
| 4,422,822 | 12/1983 | Milleron | 415/90 |

FOREIGN PATENT DOCUMENTS

| | | |
|---|---|---|
| 0023784 | 11/1981 | European Pat. Off. . |
| 1428028 | 11/1968 | Fed. Rep. of Germany . |
| 588558 | 5/1925 | France . |
| 2332790 | 6/1977 | France . |

*Primary Examiner*—Robert E. Garrett
*Assistant Examiner*—Joseph M. Pitko
*Attorney, Agent, or Firm*—Cushman, Darby & Cushman

[57] ABSTRACT

A gas-moving device comprises (a) a rotor which comprises a plurality of fibres, filaments, tapes, ribbons, strips or sheets which are mounted such that on rotation of the rotor they move in one or more planes which are substantially transverse to the axis of rotation of the rotor and draw gas into the device and cause it to flow away from the said axis towards the radial periphery of the rotor; (b) one or more gas inlet zones; (c) one or more gas outlet zones; and (d) means of rotating the rotor. The device may be provided with delivery means through which a fluid may be charged to the rotor, which fluid reacts with and removes impurities from the gas.

4 Claims, 3 Drawing Sheets

GAS-MOVING DEVICE

This is a continuation of application Ser. No. 047,521, filed May 4, 1987 which was abandoned upon the filing hereof, which is a continuation of application Ser. No. 775,362 filed Sept. 12, 1985 which was abandoned upon the filing hereof.

This invention relates to gas-moving devices.

Conventional gas-moving devices such as fans typically have either blades across which the flow of gas is in a generally radial direction or blades across which the flow of gas is in a generally axial direction. The former generate higher pressures than the latter for blades of the same radius operating at the same speed.

Because of the mass of each blade in conventional fans the blades have to be carefully manufactured and mounted such that the fan is dynamically balanced in use. Should a blade become damaged in use, or uneven wear occur, e.g. where the fan is used in an errosive or corrosive environment, or uneven build-up of a deposit occur in the fan, there is a tendency for dynamic balance to be lost which often leads to vibration and wear in the fan bearings. Furthermore, the casings of such fans often ave to be designed to be able to withstand the impact which would occur if a fragment of a blade were to break off in use.

We have now devised a gas-moving device in which the above disadvantages are at least alleviated.

According to a first aspect of the present invention there is provided a gas-moving device comprising (a) a rotor which comprises a plurality of fibres, filaments, strands, tapes, ribbons, strips or sheets which are mounted such that on rotation of the rotor they move in one or more planes which are substantially transverse to the axis of rotation of the rotor, and draw gas into the device and cause it to flow away from the said axis towards the radially outer periphery of the rotor (which fibres, filaments, strands, tapes, ribbons, strips and sheets are hereinafter referred to for convenience as "radially directed members"); (b) one or more gas inlet zones, (c) one or more gas outlet zones which is/are preferably disposed distant the axis of rotation of the rotor, and more preferably adjacent the periphery of the rotor; and (d) means for rotating the rotor (hereinafter referred to for convenience as "drive means").

Preferably the one or more gas inlet zones and the one or more gas outlet zones are provided in a housing in which the rotor is disposed.

Conveniently the radially directed members are mounted on a hub such that on rotation of the rotor they protrude therefrom in a generally radial direction.

The radially directed members may be formed from a variety of materials, e.g. metals, plastics, cotton, flax, etc. Plastics are often preferred since they have low densities and a good combination of mechanical properties. As examples of suitable plastics may be mentioned inter alia polyethylene terephthalate, polyamides, polysulphones or preferably polyalkylenes, more preferably a polyethylene, e.g. low density polyethylene. Choice of a suitable material will be made in the light of the nature of the environment, e.g. corrosivity and temperature, in which the device will be used.

It is often preferred that the radially directed members are sufficiently rigid such that when the rotor is held stationary in a horizontal plane they are self-supporting, i.e. they remain horizontal with little or no tendency to droop. It will be appreciated that where the radially directed members are not self-supporting they will, on rotation of the rotor at operational speeds, swing radially outwards to move in one or more planes which are substantially transverse to the axis of rotation of the rotor.

Where there is a tendency for the radially directed members to tear unidirectionally, it is preferred that they are mounted on the rotor such that any tears which occur tend to run in a generally radial direction with respect to the axis of rotation along the radially directed member.

The radially directed members are sufficiently deformable and flex sufficiently during rotation of the rotor such that a solid deposit tends not to build-up on the radially directed members. Solid deposits could have arisen by inter alia deposition of solid particles from the gas moving through the device, by the deposition and subsequent solidification, e.g. by cooling or evaporation of solvent, of liquid droplets from the gas moving through the device.

Depending on inter alia the material from which they are formed, the speed of rotation of the rotor, and the rate of flow of gas through the device, the radially directed members, during rotation of the rotor, deform such that their radially outer ends trail their radially inner ends.

The radially directed members may be disposed at any suitable angle on the hub, where a hub is used. Preferably they are mounted such that they extend radially outwards away from the axis of rotation of the rotor. Where the radially directed members are in the form of fibres, filaments, strands, tapes or ribbons, they are preferably disposed in one or more planes which are substantially transverse to the axis of rotation. Where the radially directed members are in the form of strips or sheets it is often preferred that they are mounted on the hub with their planes substantially parallel to the axis of rotation; however, we do not exclude the possibility that they may be mounted on the rotor such that when the rotor is stationary the plane of each radially directed member is substantially transverse to the axis of rotation of the rotor, in which case the radially directed members are constructed such that on rotation of the rotor at operational speeds they are deformed and at least a substantial proportion of the plane of each radially directed member becomes orientated to lie parallel to the aforesaid axis.

The radially directed members where they are in the form of fibres, filaments, or strands may have a variety of cross-sections. For example, they may be square, circular, triangular, cruciform, or triskellion.

The equivalent diameter of the fibres, filaments or strands, where used, is conveniently between 0.5 mm and 5 mm and often, where a fibre, filament or strand is formed from a plastic, is about 1.5 mm.

Equivalent diameter ($d_e$) is defined by the equation $$d_e = \frac{4 \times \text{cross-sectional area of fibres or filaments}}{\text{perimeter of fibres or filaments}}$$

("Chemical Engineering" by Coulson and Richardson, Volume 1, Second Edition, page 210).

Where the radially directed members are in the form of ribbons, tapes, strips or sheets the thickness of each radially directed member is typically between 10 microns and 1000 microns, e.g. 100 microns.

Where the radially directed members are in the form of fibres, filaments, strands, ribbons, tapes or strips the number thereof mounted on the rotor may lie between a few tens and many thousands. Conveniently about a couple of thousand may be used.

Where the radially directed members are in the form of sheets the number thereof mounted on the rotor may lie between a few and many hundreds. Conveniently about a hundred may be used.

We have found that a satisfactory performance can be achieved where the volume of the radially directed members is between 1 and 4 per-cent of the swept volume but we do not exclude the possibility that the said volume may lie outside this range, for example it may lie between 0.1 and 10 per-cent of the swept volume.

By "volume of radially directed members" we mean the average volume of each radially directed member multiplied by the number of radially directed members mounted on the rotor.

The radius of the rotor, and hence the length of the radially directed member may lie between a few centimetres and many metres depending on the use to which the gas-moving device is to be put. The width of each sheet, where used, is typically in the range from 10% to 80% of its length.

Conveniently the fibres, filaments, strands, ribbons or tapes, where used, are mounted in a plurality of substantially parallel layers along the axis of rotation, each of which layers is substantially transverse to the said axis. For example, four layers, each containing five hundred fibres filaments, strands, ribbons or tapes, may be used.

Preferably the radially directed members are distributed uniformly around the axis of rotation of the rotor.

In a first preferred method of forming the rotor, suitable lengths are bent at about their mid-points around a ring such that each length provides two radially directed members and the ring is then slid onto the hub and held between ring retaining means. Where a plurality of layers of radially directed members are used then a plurality of rings, each of which carries a plurality of radially directed members is used. Such a method of maintaining the radially directed members on the hub affords a mechanism for readily modifying the rotor, for example where a particular environment or use requires the presence of additional radially directed members.

In a second preferred method of forming the rotor, suitable lengths are bent at about their mid-points around a rod and a plurality of such rods, e.g. six, are symmetrically mounted on the rotor parallel to the axis of rotation thereof such that two "vanes" extend substantially radially outwards, parallel to the axis, from each rod. Such an arrangement is readily and cheaply assembled.

However, we do not exclude the possiblity that other methods of attachment well known in the engineering art may be used. For example, the radially directed members may be mounted in each of a plurality of holes or axially directed slots formed in a hub.

It will be appreciated that where the radially directed members are plastic, or are formed from naturally occurring fibres or filaments, e.g. cotton, they may be readily cut to a desired length after they have been mounted on the rotor.

The speed at which the rotor is rotated is typically the same as that at which conventional radial fans are rotated. For example, for rotors of diameter between 0.3 metres and 3 metres the speed of rotation is typically in the range from 4000 to 400 rpm.

The construction of the housing, where used, the hub, where used, and the drive means will be readily apparent to the skilled man.

Rotors used in gas-moving devices according to the present invention are substantially lighter in weight than conventional fans, rotors or impellors of similar capacity. They require no special balancing and the levels of vibration on the fan bearings are low.

Rotors used in gas-moving devices according to the present invention often have a large surface area. For example, in a rotor of about 30 cms diameter and 8 cms axial depth which comprises fibres, filaments or strands, a surface area of about 1 metre$^2$ is readily obtainable.

The high surface area of such rotors allows gas-moving devices according to the present invention to be used in gas-contacting devices, e.g. gas-scrubbing devices, where it is desired to remove impurities from the gas.

According to a second aspect of the present invention there is provided a gas-contacting device comprising a gas-moving device as hereinbefore defined, wherein the rotor preferably comprises fibres, filaments or strands, and delivery means associated therewith through which delivery means a fluid which is capable of reacting with an impurity in the gas flowing through the device is delivered.

Conveniently the delivery means is provided by a pipe mounted in the inlet zone adjacent the rotor.

Fluids which may be delivered through the delivery means include inter alia pourable particulate solids and liquids. The liquids may be neat liquids, solutions, slurries, dispersions, etc.

Where the fluid which is delivered through the delivery means is a liquid, it is conveniently an aqueous liquid, e.g. water, or a lime or limestone slurry. However, we do not exclude the possibility that other liquids may be used. Choice of a suitable liquid will be made in the light of inter alia the nature and concentration of the impurity which is to be treated.

As examples of particulate solid impurities which may be removed in the gas-contacting device according to the present invention may be mentioned calcium hydroxide dust associated with alkali processes, and fines from, for example, catalyst or dyestuff handling plants.

As examples of gases which contain gaseous impurities and which may be charged to the gas-contacting device may be mentioned combustion flue gases containing sulphur dioxide, and oxides of nitrogen; and air which it is desired to clean for use in a public or domestic environment.

Where the impurity in a gas charged to the gas-contacting device according to the present invention is a particulate solid and the fluid delivered through the delivery means is a liquid it is preferred that the gas discharged from the gas-contacting device is fed to a demisting device in which droplets of the liquid may be removed. The demisting device may be a demisting tower, a cyclone or a set of inclined plates, etc.

We do not exclude the possibility that a device according to the present invention may be coupled in series, preferably co-current, flow with a fan.

The present invention will be further illustrated by reference to the accompanying drawings which show, by way of example only, a gas-moving device and a gas-contacting device according to the present invention.

In the drawings:

FIG. 4 is a cross-section on the line AA of FIG. 3.

Figure 1:
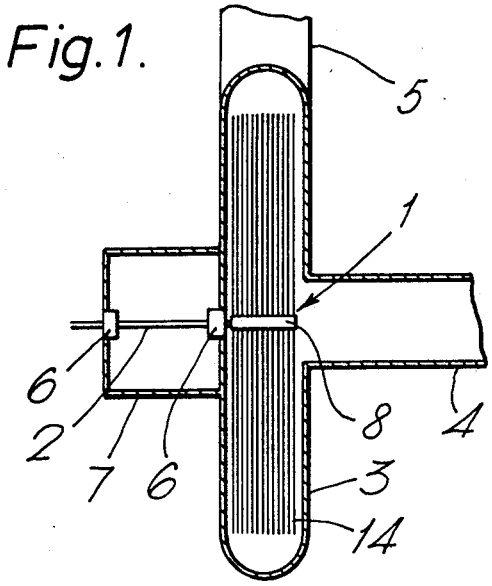
FIG. 1 is a schematic representation of a gas-moving device according to the present invention.
Figure 2:
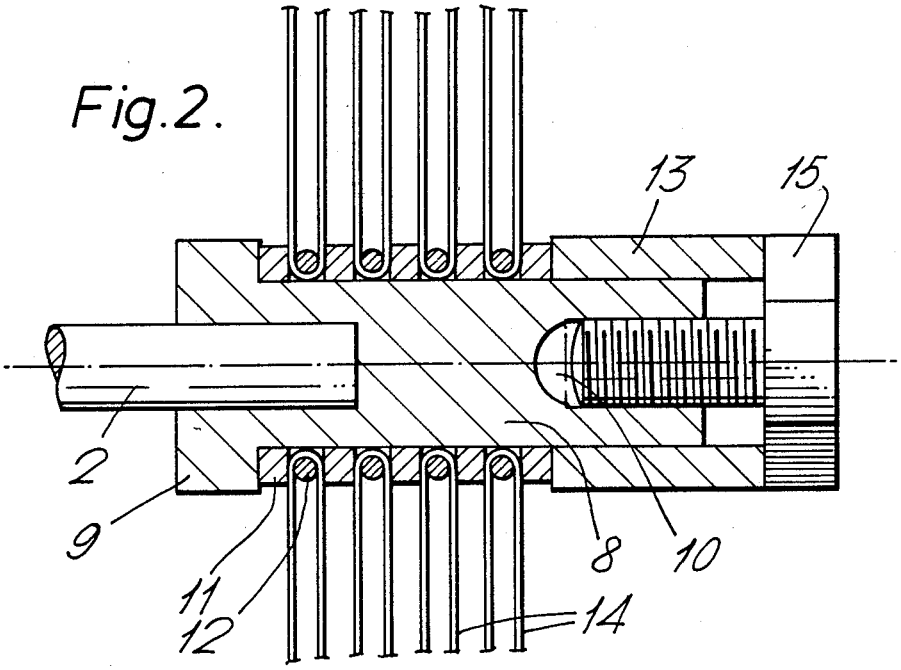
FIG. 2 is a detail of FIG. 1 showing the assembly of the fibres or filaments on the hub of the rotor.

In FIGS. 1 and 2, a rotor 1 is mounted on drive shaft 2 in housing 3 which is provided with inlet duct 4 and outlet duct 5. The drive shaft 2 extends through bearings 6 in a support frame 7 and is attached to electric drive means (not shown). The rotor 1 comprises a hub 8 one end of which, formed with flange 9, is mounted on the drive shaft 2 and the other end is provided with a tapped hole 10. Mounted alternately on the hub are rubber gaskets 11 and metal rings 12 followed by a slidable sleeve 13. Around each of the metal rings 12, a plurality of lengths of polythene of cruciform cross-section are bent to form fibres or filaments 14. Bolt 15 is screwed into hole 10 to drive the sleeve 13 along the hub so that the fibres or filaments are attached securely between the rubber gaskets 11 and the metal rings 12.

In use, the rotor 1 is rotated by the drive means and air is sucked in via inlet duct 4 and is expelled under pressure via outlet duct 5.

Figure 3:
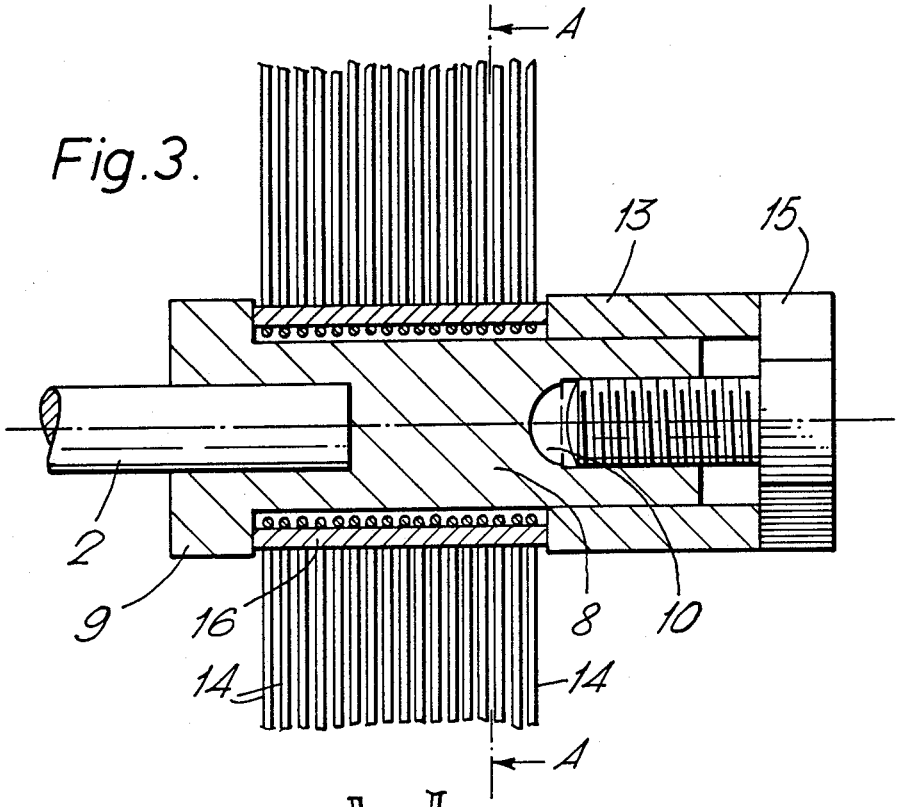
FIGS. 3 and 4 show an alternative arrangement of fibres or filaments on the hub of a rotor.
Figure 4:
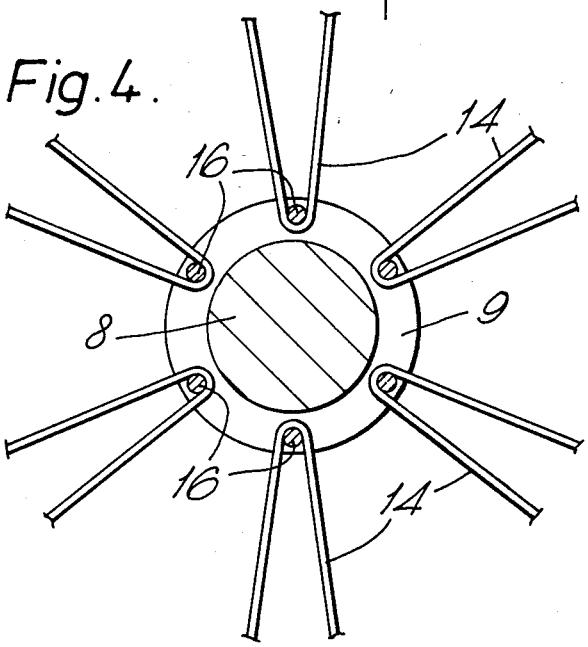
Figure 5:
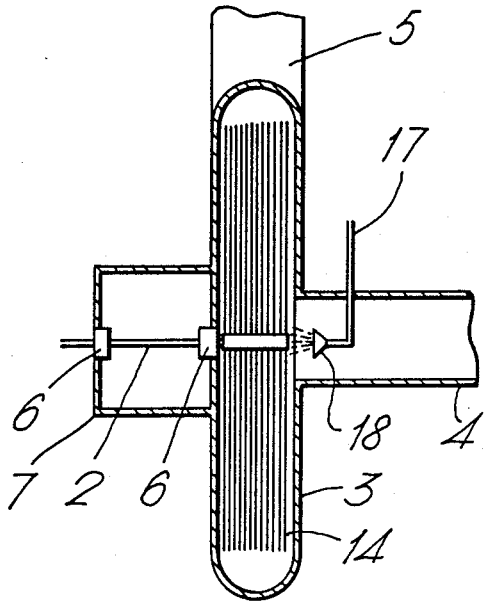
FIG. 5 is a schematic representation of a gas-contacting device according to the present invention.

In FIGS. 3, 4 and 5, parts corresponding to those of FIGS. 1 and 2 are indicated by use of the same numbering.

In FIGS. 3 and 4, six rods 16 are mounted in the flange 9 and sleeve 13 symmetrically about the hub 8. Around each of the rods 16, a plurality of lengths of polythene are bent to form fibres or filaments 14 which project from the hub in the form of vanes.

In FIG. 5, a pipe 17 provided at its end with a delivery nozzle 18 is provided in inlet duct 4. In operation a spray of fluid, e.g. water, from the delivery nozzle impinges on the fibres 14 and wets them. Impurities in the incoming gas are then subjected to a large wet surface provided by the layer of liquid on the fibres and hence reaction of impurities in the gas with the liquid is facilitated. Where the impurity is a particulate solid, the collected particles tend to run along the fibres and are thrown off by centrifugal force onto a suitable collection area in the form of a sludge.

The present invention is further illustrated by the following example.

EXAMPLE 1

Nitrogen containing terephthalic acid dust (3 grams metres$^3$) was drawn at a rate of 300 metres$^3$/hour through a gas-contacting device as described in FIG. 5 comprising a rotor of diameter 22.5 centimetres and axial length 6.2 centimetres bearing 960 polythene fibres of cruciform cross-section. A fine spray of water at 90° C. and at a rate of 300 kilograms per hour was charged to the device through a nozzle mounted in the inlet duct. The concentration of terephthalic acid in the nitrogen discharged from the device was found to be 10 ppm.

What is claimed:

1. A gas moving device comprising:

(a) a rotor which comprises a plurality of flexible radially directed members comprising fibres, filaments, strands, tapes, ribbons, strips or sheet members which are formed from a plastic materials, and which are mounted on a hub member, such that said plastic members move in one or more planes which are substantially transverse to the axis of rotation of the rotor, and draw gas into the device and cause it to flow away from said axis towards the radially outer periphery of the rotor, the volume of the radially directed members being between 1 and 4% of the swept volume;

(b) housing means for surrounding said rotor;

(c) a gas inlet formed in said housing means;

(d) a gas outlet formed in said housing means;

(e) means for rotating the rotor; and (f) delivery means within the housing positioned between said gas inlet and said hub member and adjacent said rotor for supplying a fluid spray essentially axially against said radially directed members, wherein said inlet is disposed opposite said hub member; and has a cross-sectional area greater than the cross-sectional area of said hub member and has a cross-sectional area greater than the cross-sectional area of said hub member.

2. A gas-moving device as claimed in claim 1 wherein the gas outlet zone is distant from the said axis of rotation.

3. A gas-moving device as claimed in claim 1 wherein the radially directed members are mounted on a hub.

4. A gas-moving device as claimed in claim 1 wherein the plastics material is a polyolefin.

* * * * *